US006326595B2

(12) United States Patent
Taniguchi et al.

(10) Patent No.: US 6,326,595 B2
(45) Date of Patent: Dec. 4, 2001

(54) GLOW PLUG WITH GLASS COATING OVER ION DETECTION ELECTRODE

(75) Inventors: Masato Taniguchi; Hiroyuki Kimata, both of Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/729,723

(22) Filed: Dec. 6, 2000

(30) Foreign Application Priority Data

Dec. 8, 1999 (JP) ..... 11-349530

(51) Int. Cl.[7] ..... F23Q 7/00
(52) U.S. Cl. ..... 219/270; 123/145 A
(58) Field of Search ..... 219/270, 544; 123/145 A, 145 R; 361/264–266

(56) References Cited

U.S. PATENT DOCUMENTS 5,893,993 * 4/1999 Kurano ..... 219/270
5,922,229 * 7/1999 Kurano ..... 219/270
6,062,185 * 5/2000 Chiu et al. ..... 123/145 A
6,148,660 * 11/2000 Chiu et al. ..... 73/35.08
6,215,105 * 4/2001 Simpkins et al. ..... 219/270
6,248,980 * 6/2001 Chiu et al. ..... 219/270

FOREIGN PATENT DOCUMENTS 10-110952 4/1998 (JP) .
10-89226 4/1998 (JP) .
10-89687 4/1998 (JP) .
834 652 4/1998 (EP) .
10-122114 5/1998 (JP) .
11-248156 * 9/1999 (JP) .
11-270849 * 10/1999 (JP) .

* cited by examiner

*Primary Examiner*—John A. Jeffery
(74) *Attorney, Agent, or Firm*—Sughrue, Mion, Zinn, Macpeak & Seas, PLLC

(57) ABSTRACT

A glow plug includes a metallic sleeve 1; a cylindrical metallic shell 2, which holds the metallic sleeve 1; a terminal electrode 3, which is attached into the cylindrical metallic shell 2 while being insulated therefrom; a ceramic heating member 4, which is fitted into the metallic sleeve 1; and a glass coating layer 5. In the glow plug, a portion of an ion detection electrode 411 is exposed at the surface of an insulator 44 of the ceramic heating member 4. The exposed portion is coated with a glass coating layer 5, which is formed in such a manner as to extend all around the insulator 44 of the ceramic heating member 4 and has a thickness of 10–200 $\mu$m and a softening point of not lower than 600° C.

6 Claims, 6 Drawing Sheets

GLOW PLUG WITH GLASS COATING OVER ION DETECTION ELECTRODE

BACKGROUND OF THE INVENTION

1. Field of the Invention

The present invention relates to a glow plug and a method for manufacturing the same. More particularly, the invention relates to a glow plug exhibiting excellent durability, being capable of preventing short circuits potentially caused by adhesion of carbon, ensuring safety, and being capable of detecting ion current accurately, as well as to a method for manufacturing the same.

2. Description of the Related Art

In recent years, in order to reduce exhaust gas or exhaust smoke from a gasoline engine or a diesel engine, the engine combustion control system of the engine has been required to detect the state of combustion of the engine. The state of combustion of the engine has been detected in terms of, for example, cylinder pressure, light from combustion, or ion current. Particularly, detection of ion current has been considered useful, since a chemical reaction which accompanies combustion can be observed directly. In order to detect ion current, a glow plug into which an ion detection electrode is incorporated has been proposed (see, for example, Japanese Patent Application Laid-Open (kokai) No. 10-122114).

In the case of a diesel engine equipped with a glow plug into which an ion detection electrode is incorporated, when carbon produced in the combustion chamber adheres to the ion detection electrode, a short circuit is formed, or a leakage current flows, which impairs ion current detection accuracy. Accordingly, the ion detection electrode must be exposed to a region in a temperature zone in which carbon is burned off by a heater. Thus, the exposed portion of the ion electrode is required to exhibit excellent heat resistance and consumption resistance. Conventional glow plugs which have solved the above problems include, for example, a glow plug in which an ion detection electrode is made of a noble metal, such as Pt, in order to ensure heat resistance and consumption resistance thereof, or in which an exposed portion of the ion detection electrode is metallized with a conductive layer (Japanese Patent Application Laid-Open (kokai) No. 10-89687); and a glow plug in which an ion detection electrode is coated with a noble metal, such as Pt, Ir, or Rh, or an insulative porous layer, which is formed by sintering an electrically insulative ceramic powder, such as alumina (Japanese Patent Application Laid-Open (kokai) No. 10-110952 or 10-89226).

However, use of an ion detection electrode or a coating layer made of a noble metal, such as Pt, results in a very expensive glow plug. Also, use of an ion detection electrode made of a noble metal, such as Pt, is likely to cause stress concentration in an insulator in the vicinity of the ion detection electrode. This is because thermal expansion differs between the noble metal and ceramics, which the insulator is made of. As a result, the glow plug may suffer damage, such as cracking. In the case where an exposed portion of an ion detection electrode is metallized with a conductive layer, there is a difficulty in selecting a material for the coating layer. This is because the material must exhibit corrosion resistance at an operating temperature of a glow plug; i.e., 1000° C. or higher, and must be able to prevent separation of the coating layer which potentially results from a difference in thermal expansion. In the case where an exposed portion of an ion detection electrode is coated with an insulative porous layer, the durability of the coating layer may suffer. This is because the porous feature of the coating layer means an increase in the surface area of the coating layer exposed to combustion gas.

Since the tip of a glow plug assumes a high temperature, studies have been carried out on a glow plug in which an ion detection electrode is exposed at a side region of an insulator, not at a tip region of the insulator, so as to ensure heat resistance (see FIG. 1). This configuration involves difficulty in sensing ions which have reached a side region of the insulator opposite the ion detection electrode. Also, the orientation of the ion detection electrode varies depending on the state of attachment of the glow plug, resulting in variations in detection of ion current; i.e., impaired accuracy in detection of ion current.

SUMMARY OF THE INVENTION

The present invention has been achieved in view of the foregoing, and an object of the invention is to provide a glow plug exhibiting excellent durability, being capable of preventing short circuits potentially caused by adhesion of carbon, ensuring safety, and being capable of detecting ion current accurately, as well as a method for manufacturing the same.

The present inventors have studied a glow plug and a method for manufacturing the same in view of the foregoing, and found that glass, which is considered an insulating layer, exhibits sufficient ion conductivity for detection of ion current when the temperature thereof rises as a result of operation of an engine or a glow plug. Based on these findings, the inventors achieved the present invention. Specifically, they found that a glow plug including a heating resistor and an ion detection electrode which are disposed within an insulator exhibits excellent durability, prevents short circuits potentially caused by adhesion of carbon, and can accurately detect ion current, by employing the following structural feature: a portion of the ion detection electrode is exposed at the surface of the insulator, and the exposed portion is coated with a glass coating layer.

A glow plug according to the invention comprises a ceramic heating member which in turn comprises an insulator, a heating resistor disposed within the insulator, and an ion detection electrode disposed within the insulator. The glow plug is characterized in that a portion of the ion detection electrode is exposed through the insulator of the ceramic heating member and the exposed portion is coated with a glass coating layer.

BRIEF DESCRIPTION OF THE DRAWINGS

FIG. 2(*b*) is a sectional view taken along line B–B' of FIG. 2(*a*);

Figure 1:
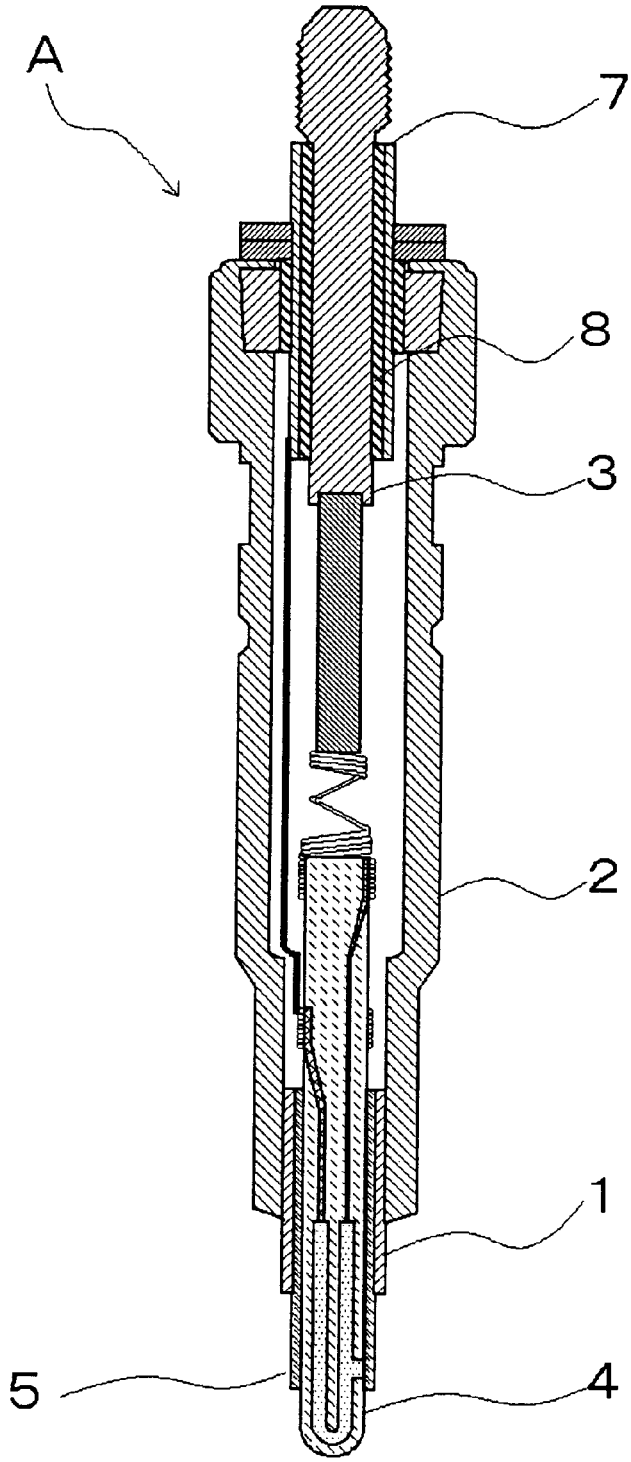
FIG. 1 is a longitudinal sectional view of a glow plug according to an embodiment of the present invention.

Reference numerals are used to identify elements shown in the drawings as follows: A: glow plug; 1: metallic sleeve; 2: cylindrical metallic shell; 3: terminal electrode; 4: ceramic heating member; 41: heating resistor; 411: ion detection electrode; 42, 43: lead wires; 44: insulator; 5: glass coating layer; 61, 62, 63: external connection wires; 64, 65: external lead wires; 7: terminal lead conduit; 8: glass seal; 9: cylinder head; 91: swirl chamber; 92: main combustion chamber; 93: piston; 94: fuel injection nozzle; 10, 11: glow relay; 12: battery; 13: direct-current power source; 14: ion current detection resistor; 141: potentiometer; 15: brazing material

DESCRIPTION OF THE PREFERRED EMBODIMENTS

Figure 2:
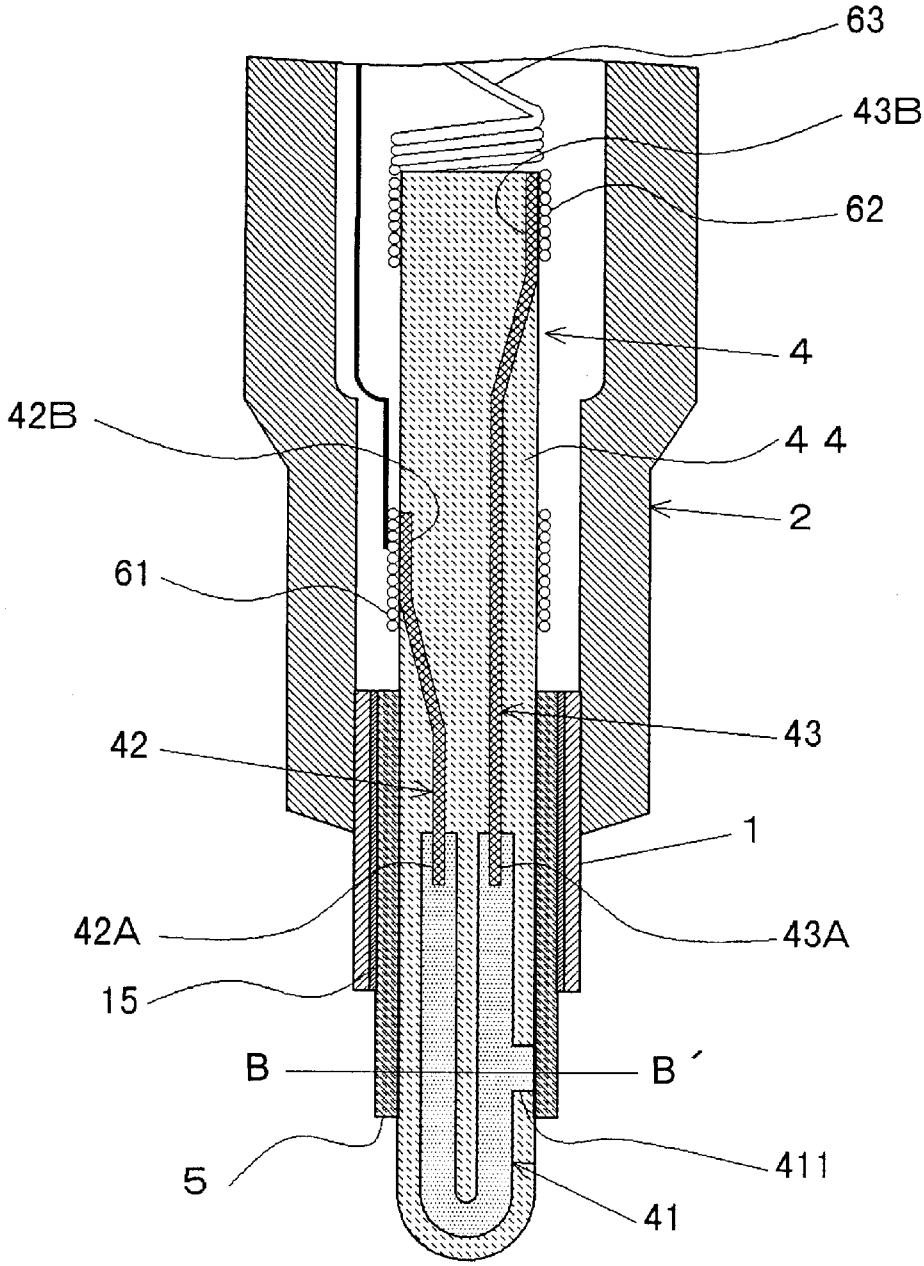
FIG. 2(*a*) is an enlarged longitudinal sectional view of a main portion of the glow plug of FIG. 1.
Figure 2:
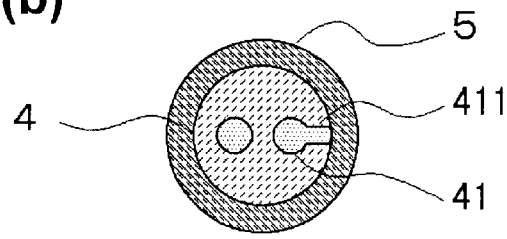

FIGS. 1 and 2 show an example of a glow plug of the first embodiment of the invention.

As shown in FIG. 1, a glow plug A includes a metallic sleeve 1; a cylindrical metallic shell 2, which holds the metallic sleeve 1; a terminal electrode 3, which is attached into the cylindrical metallic shell 2 while being insulated therefrom; a ceramic heating member 4, which is fitted into the metallic sleeve 1; and a glass coating layer 5.

A rear portion of the metallic sleeve 1 is fixedly attached to the inner wall of the cylindrical metallic shell 2 by means of a glass seal. The terminal electrode 3 is fixedly attached to the cylindrical metallic shell 2 and a terminal lead conduit 7 while being insulated therefrom, by means of a glass seal 8. The ceramic heating member 4 assumes a substantially circular cross section. The glass coating layer 5 is formed on the ceramic heating member 4 so as to cover the exposed portion of the ion detection electrode and to extend along the substantially circular circumference of the ceramic heating member 4.

As shown in FIG. 2, the ceramic heating member 4 is configured such that a U-shaped heating resistor 41 and lead wires 42 and 43 are embedded in an insulator 44. The U-shaped heating resistor 41 includes an ion detection electrode 411, which projects from a side portion thereof. The ion detection electrode 411 is exposed at a side portion of the ceramic heating member 4.

As shown in FIG. 2, one end 42A of the lead wire 42 and one end 43A of the lead wire 43 are connected to the corresponding end portions of the heating resistor 41. The other end 42B of the lead wire 42 is exposed at the surface of an intermediate portion of the insulator 44, whereas the other end 43B of the lead wire 43 is exposed at the surface of a rear portion of the insulator 44. The other end 42B of the lead wire 42 is electrically connected to the terminal lead conduit 7 via a helical external connection wire 61 and a coated Ni lead. The other end 43B of the lead wire 43 is electrically connected to the terminal electrode 3 via helical external connection lines 62 and 63.

The "glass coating layer" 5 in the first embodiment of the invention is made of glass which contains $SiO_2$ as a main component, and is formed on the surface of the ceramic heating member 4 so as to cover the exposed portion of the ion detection electrode 411. Trace components other than $SiO_2$ of the glass forming the "glass coating layer" 5 are not particularly limited. However, alkali metals, such as Na and K, are preferably contained, since such alkali metals, if present, improve the ion conductivity of the glass coating layer 5 to thereby enable accurate detection of ion current. The "glass coating layer" 5 must cover at least a portion of the ion detection electrode 411 which is exposed from the insulator 44 of the ceramic heating member 4. In this regard, the glass coating layer 5 may be formed so as to cover a wider region in order to detect not only ions which have reached a region located above the ion detection electrode 411, but also ions which have reached any portion of the glass coating layer 5. In a further preferred embodiment of the invention, the glass coating layer may be formed so as to cover the exposed portion and to extend all around the insulator of the ceramic heating member as shown in FIG. 2(*b*), which is sectional view taken along line B–B'.

Since such glass penetrates into grain boundaries of ceramic forming the insulator 44, the formed glass coating layer 5 is completely integrated with the insulator 44, thereby avoiding potential separation thereof from the ceramic heating member 4. When glass is softened at high temperature, the apparent Young's modulus thereof drops. Thus, stress concentration does not occur, thereby preventing the occurrence of cracking, with a resultant improvement in durability of the glass coating layer 5.

The thickness of the "glass coating layer" 5 is not particularly limited. The thickness is preferably 10–200 $\mu$m, and is more preferably 20–100 $\mu$m, even more preferably 30–60 $\mu$m. When the thickness of the glass coating layer 5 is less than 10 $\mu$m, the durability of the glass coating layer 5 is impaired. When the thickness is in excess of 200 $\mu$m, the strength of the glass coating layer 5 is impaired due to increased thermal stress, and again the durability of the glass coating layer 5 is impaired.

The softening point of the "glass coating layer" 5 is not particularly limited. However, the softening point is preferably not lower than 600° C., and is preferably not lower than 700° C., more preferably not lower than 800° C. When the softening point of the glass coating layer 5 is lower than 600° C., glass which forms the glass coating layer 5 may run while the vehicle is traveling, potentially resulting in exposure of the ion detection electrode 411 to combustion gas. Notably, the above-mentioned softening point is also called the Littleton point and indicates temperature as measured at a viscosity of $4.5\times10^7$ poise. The softening point may be measured by using a differential thermal analyzer.

In the first embodiment of the invention, a position where the "ion detection electrode" 411 is exposed is not particularly limited. Usually, as shown in FIGS. 1 and 2, the ion detection electrode 411 is exposed at a side surface of the ceramic heating member 4, but may be exposed at a tip portion of the ceramic heating member 4. When the ion detection electrode 411 is exposed at a side surface of the ceramic heating member 4, the distance between the ion detection electrode 411 and the metallic sleeve 1 can be made 2 mm or less. In this case, since the ion detection electrode 411 can be located at a position which is advantageous in terms of temperature, the durability of the glow plug is improved, resulting in extended life of the glow plug. Since the glass coating layer 5 is electrically nonconductive at near room temperature, shortening the distance between the ion detection electrode 411 and the metallic sleeve 1 does not result in a short circuit potentially caused by adhesion of carbon.

Figure 6:
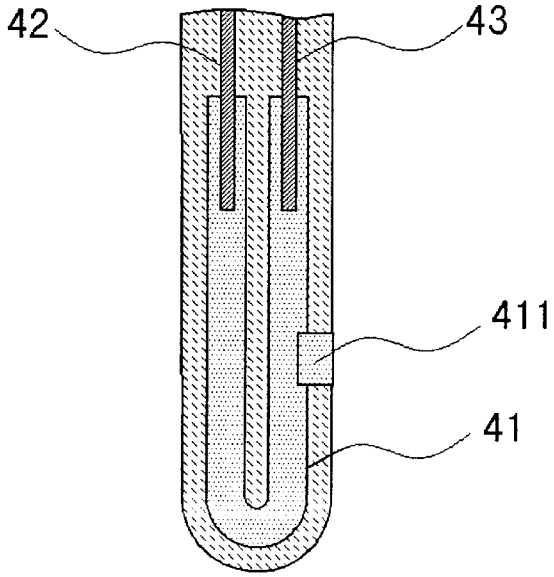
FIG. 6 is an enlarged longitudinal sectional view of a main portion of a glow plug according to another embodiment of the present invention.

Materials for the "ion detection electrode" 411 and the "heating resistor" 41 in the first embodiment of the invention are not particularly limited. Usually, the ion detection electrode 411 and the heating resistor 41 are formed by sintering a ceramic compact ($Si_3N_4$, $SiO_2$, WC, rare earth oxide, or the like). Also, W, Ir, Ta, and Pt, for example, are usable materials. As shown in FIG. 6, the "ion detection electrode" 411 and the "heating resistor" 41 may be made of different materials. Preferably, the ion detection electrode 411 and the heating resistor 41 are made of the same material so that they can be integrally formed; i.e., they can be manufactured efficiently (see FIGS. 3 and 4). In the first embodiment of the invention the "ion detection electrode" 411 and the "heating resistor" 41 are integrated into a single unit, but they may be formed as different elements.

Material for the "insulator" 44 in the first embodiment of the invention is not particularly limited so long as the material has insulating properties. The insulator 44 may be made of $Al_2O_3$, but is preferably formed by sintering a ceramic compact which contains $Si_3N_4$ as a main component. This is because properties such as strength and toughness of the thus-formed insulator 44 are balanced.

A method for manufacturing a glow plug embodying the invention is characterized by coating with a glass coating layer a portion of an ion detection electrode disposed within the insulator of the ceramic heating member, the portion being exposed from the insulator. The coating method is not particularly limited so long as the portion of the ion detection electrode which is exposed from the insulator of the ceramic heating member can be coated.

Use of a glow plug A of the present invention will next be described with reference to FIG. 7. When the engine is started, glow relays 10 and 11 are turned on to thereby close the circuit between a battery 12 and the heating resistor 41 of the glow plug A. As a result, current flows through the heating resistor 41, to generate heat. Thus, the glow plug A is heated to firing temperature. Each time fuel is injected from a fuel injection nozzle 94, the injected fuel is ignited, causing a piston 93 to operate. Thus the engine is driven.

During the above operation, a large amount of positive and negative ions are generated in the combustion-flame region. Since a direct-current power source 13 applies voltage between a cylinder head 9 and the ion detection electrode 411 of the glow plug A, the ion detection electrode 411 and the cylinder head 9 capture ions. Thus, an ion current flows through a current circuit including an ion current detection resistor 14. A potentiometer 141 detects the ion current in the form of potential difference across the ion current detection resistor 14.

Near room temperature, the resistivity of glass is very high, and thus glass is electrically nonconductive. Adhesion of carbon, if any, does not cause a short circuit. As the temperature rises, movement of alkali metal ions contained in glass becomes intensive. At the softening point of glass or higher temperature, glass becomes electrically conductive. Accordingly, by coating with a glass coating layer as specified in the present invention, not only ions which have reached a region located above the ion detection electrode, but also ions which have reached any portion of the glass coating layer can be detected. Thus, ion current can be detected accurately, whereby the state of ionization during operation is accurately determined.

The present invention will next be described specifically by reference to the following Examples and comparative Examples. However, the present invention should not be construed as being limited thereto.

(1) Configuration of Glow Plug of the Present Embodiment

A glow plug of the present embodiment is shown in FIGS. 1 to 5.

In the glow plug of the present embodiment, the metallic sleeve 1 has a wall thickness of 0.6 mm and is made of a heat-resistant metal, and the cylindrical metallic shell 2 is made of carbon steel. The heating resistor 41 excluding the exposed portion of the ion detection electrode 411 is embedded in the insulator 4 such that the distance between the surface of the heating resistor 41 and the surface of the insulator 4 is not less than 0.3 mm. Thus, even when the heating resistor 41 assumes a high temperature (800° C. to 1500° C.) when the glow plug is in use, the heating resistor 41 can be protected from oxidation and can maintain a high mechanical strength. The lead wires 42 and 43 are each manufactured in the following manner: a W wire having a diameter of 0.3 mm to 0.4 mm is electroplated with silver such that the plating thickness becomes 3 $\mu$m.

(2) Fabrication of Glow Plug of the Present Embodiment

First, a material for the heating resistor 41 is prepared. The material contains 60.0 wt % WC and 40 wt % insulative ceramic ($Si_3N_4$:85 parts by weight; rare earth oxide: 10 parts by weight; $SiO_2$:5 parts by weight). A dispersant and a solvent are added to the material, followed by pulverizing and drying. An organic binder is added to the pulverized substance, to thereby obtain a granular substance.

Next, the W wire is cut to pieces, each having a predetermined length. The cut pieces are formed into predetermined shapes. The thus-formed W wire pieces are electroplated with silver such that the plating thickness becomes 3 $\mu$m, to thereby obtain the lead wires 42 and 43.

Figure 3:
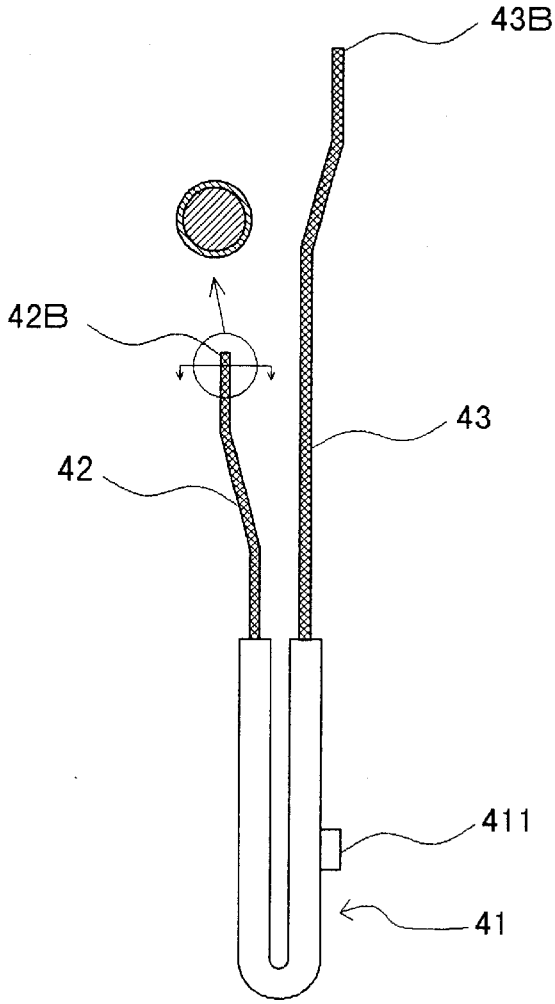
FIG. 3 is a view illustrating an integrated assembly of a heating resistor and lead wires.
Figure 4:
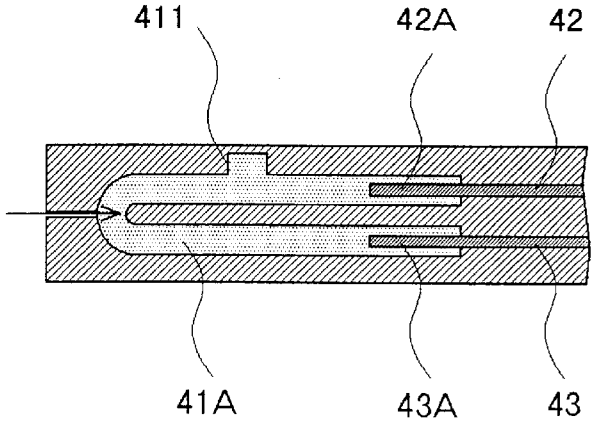
FIG. 4 is a view illustrating injection molding for manufacturing an integrated assembly of a heating resistor and lead wires.

As shown in FIG. 4, the above granular substance is injection molded so as to connect to the ends 42A and 43A of the lead wires 42 and 43, thereby forming a U-shaped green heating resistor 41A and the lead wires 42 and 43 integral with each other as shown in FIG. 3. In this molding step, a protrusion which will become the ion detection electrode 411 is formed on the green heating resistor 41A so as to become a protruding portion of the heating resistor 41. In a later step, the protruding portion can be exposed at the surface of the insulator by polishing. Notably, when a W electrode or Ir electrode is used as the ion detection electrode, the W electrode or Ir electrode is disposed at a position corresponding to the protrusion before the granular substance is injection molded, so as to integrate the W electrode or Ir electrode with the green heating resistor 41A.

Figure 5:
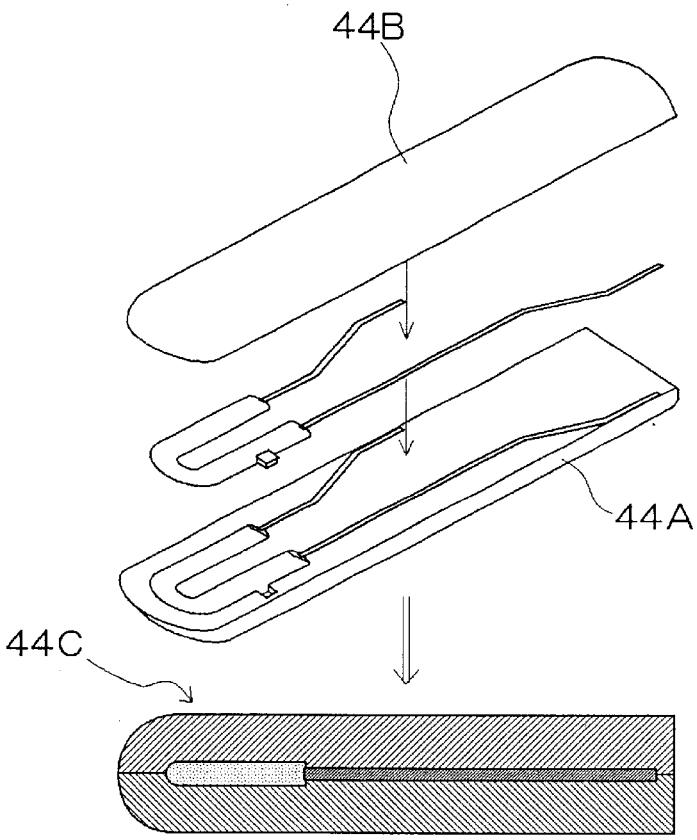
FIG. 5 is a view illustrating a step of forming a compact assembly by pressing.

Next, a ceramic powder which the insulator 44 is made of is prepared. $Si_3N_4$ (85 parts by weight), rare earth oxide (10 parts by weight), and $SiO_2$ (5 parts by weight) are mixed to obtain the ceramic powder. An organic binder is added to the ceramic powder to thereby obtain a granular substance. As shown in FIG. 5, a pair of compact halves 44A and 44B are formed from the granular substance. The integrated unit shown in FIG. 3 is placed on the compact half 44A, and then the compact half 44B is placed on the compact half 44A. The resulting assembly is pressed to thereby obtain a compact 44C.

The compact 44C is hot pressed in a nitrogen gas atmosphere at a temperature of 1750° C. by applying a pressure of 200 kg/cm$^2$, thereby forming a sintered ceramic body assuming the form of a substantially round bar and having a hemispherical tip portion. The surface of the sintered ceramic body is polished into the form of a column having predetermined dimensions and so as to expose the other ends 42B and 43B of the lead wires 42 and 43 at the surface of the sintered ceramic body. The ceramic heating member 4 is thus completed.

A glass layer is formed on the ceramic heating member 4 by baking in such a manner as to extend all around the insulator 44 and to cover the exposed portion of the ion detection electrode and a portion of the insulator 44 which is to be held by the metallic sleeve 1. For example, a glass paste is first prepared by mixing a glass powder (product of Asahi Glass Co., 103) with a binder and a solvent. The glass paste is then coated on the ceramic heating member 4 and dried at a temperature of 120° C. for 10–20 minutes and baked for 5 minutes in a hydrogen-nitrogen atmosphere at a temperature of 1300° C. The glass layer is composed, e.g., of $SiO_2.B_2O_3.R_2O$ (R: alkali metal, e.g., Li, Na, K) high-melting-point glass (softening point: 820° C.).

The ceramic heating member 4 and the metallic sleeve 1, and the ceramic heating member 4 and the external connection wires 61 and 62 are electrically connected by brazing. The external connection wires 61 and 62 are electrically connected to the terminal lead conduit 7 and the terminal electrode 3, respectively. Subsequently, the resulting assembly of the ceramic heating member 4 is inserted into the cylindrical metallic shell 2. A rear portion of the metallic sleeve 1 is silver brazed to the inner wall of a holder portion of the cylindrical metallic shell 2. Finally, an end of the cylindrical metallic shell 2 is caulked, thereby completing a dual insulation type glow plug A.

(2) Evaluation of Performance of Glow Plug

① Durability-to-Energization Test

Glow plugs of Examples 1 to 6 and comparative Examples 1 to 5 were manufactured according to the above-described method while employing the materials for the ion detection electrode and the coating layer and the thickness of the coating layer as specified in Table 1. The glow plugs were subjected to a durability-to-energization test, of 10,000 cycles, to thereby evaluate their durability to energization. Each cycle is composed of 1-minute energization (temperature of tip portion of insulator: 1400° C.) and 1-minute de-energization (cooled to room temperature). The test results are shown in Table 1. In Table 1, the term "heating element" appearing in the "Electrode Material" column means that the ion detection electrode 411 and the heating resistor 41 are made of the same material.

TABLE 1

| | Electrode Material | Electrode Coating | Coating Thickness | Results |
|---|---|---|---|---|
| Example 1 | Heating element | Glass | 5 μm | Swelling of heating element due to oxidation after 2000 cycles |
| Example 2 | Heating element | Glass | 10 μm | No anomaly after 10000 cycles |
| Example 3 | Heating element | Glass | 50 μm | No anomaly after 10000 cycles |
| Example 4 | Heating element | Glass | 100 μm | No anomaly after 10000 cycles |
| Example 5 | Heating element | Glass | 200 μm | No anomaly after 10000 cycles |
| Example 6 | W | Glass | 20 μm | No anomaly after 10000 cycles |
| Comparative Example 1 | Heating element | Not coated | 0 | Swelling of electrode due to oxidation after 100 cycles |
| Comparative Example 2 | W | Not coated | 0 | Swelling of electrode due to oxidation after 50 cycles |
| Comparative Example 3 | Ir | Not coated | 0 | Cracking of insulator after 1200 cycles |
| Comparative Example 4 | W | Au deposition | 2 μm | Swelling of electrode due to oxidation after 250 cycles |
| Comparative Example 5 | W | Au—Ni applied by baking | 15 μm | Separation of coating layer after 400 cycles |

② Durability-on-Engine Test

A durability-on-engine test was conducted using a 4-cylinder diesel engine (2400 cc).

Figure 7:
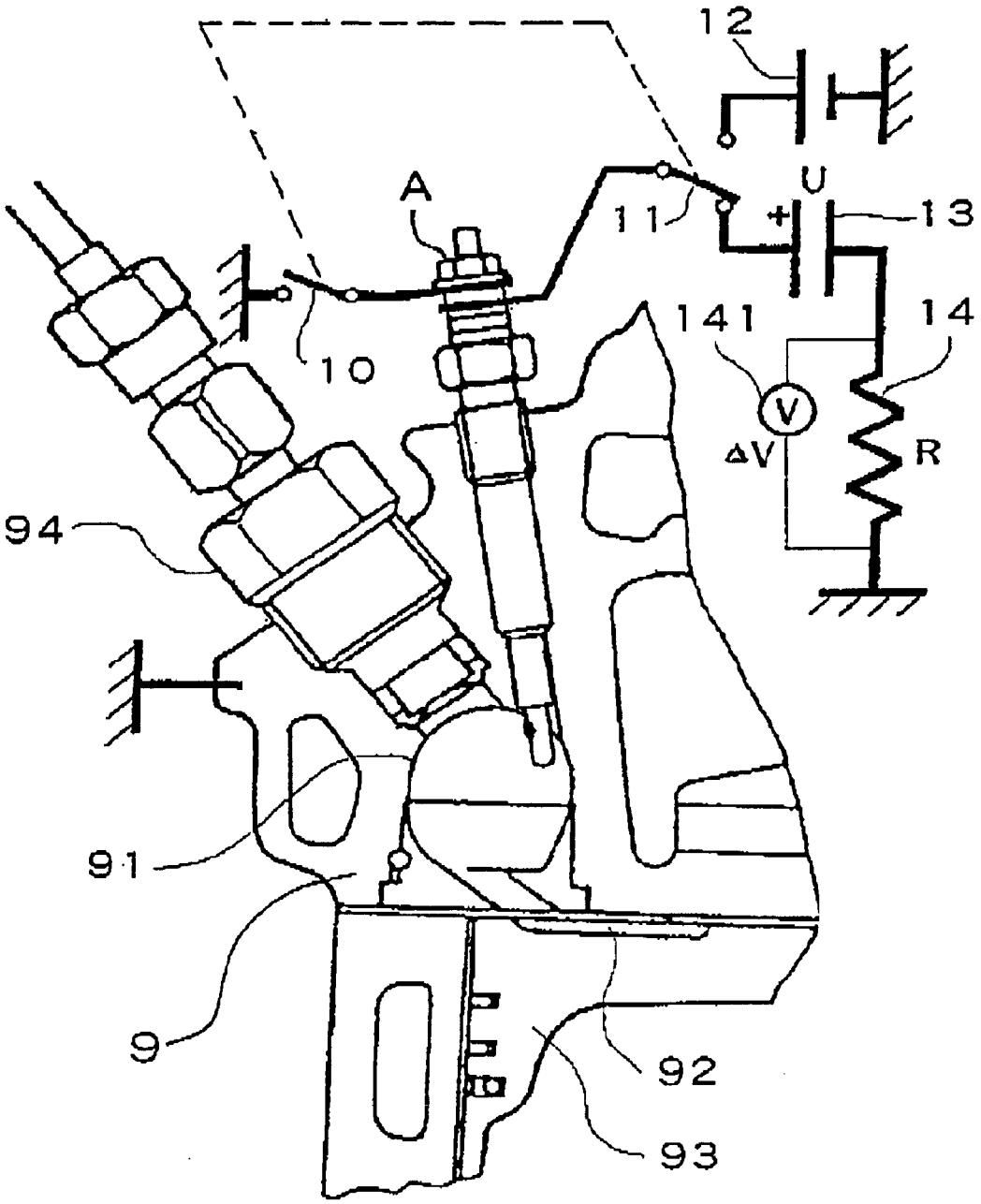
FIG. 7 is a view illustrating a state in which the glow plug of FIG. 1 is mounted on an engine while being connected to a glow plug operation circuit.

Each of the glow plugs of Examples 7 to 11 and comparative Examples 6 to 9 was mounted on the engine such that an externally threaded portion of the cylindrical metallic shell 2 was screwed into the cylinder head 9 of the engine as shown in FIG. 7. The glow plug A is mounted such that a tip portion thereof projects into a swirl chamber 91, which is a portion of a combustion chamber of the cylinder head 9.

As shown in FIG. 7, the glow plug is connected to a glow plug operation circuit. Specifically, glow relays 10 and 11 and a 12 V battery 12 in the glow plug operation circuit are electrically connected to the lead wires 42 and 43 by means of external lead wires 64 and 65 and via the terminal lead conduit 7 and the terminal electrode 3, thereby forming a heating circuit for the heating resistor 41. An ion detection circuit is connected to the ion current detection resistor 14 via the direct-current power source 13. The potentiometer 141 is connected to the ion current detection resistor 14 in order to detect ion current.

The durability-on-engine test was conducted for 1000 cycles in a mode operation. Each cycle included the following steps (4 minutes per cycle).

① Engine speed 0 rpm (engine in halt)

The heating member is energized for 1 minute, and the ion detection electrode is de-energized.

② Engine speed 700 rpm, no load (idling)

The heating member is de-energized, and the ion detection electrode is energized for 1 minute.

③ Engine speed 3600 rpm, full load

The heating member is de-energized, and the ion detection electrode is energized for 2 minutes.

The test results are shown in Table 2. In Table 2, the term "short" appearing in the "Results" column means that adhesion of carbon to the ion detection electrode caused a short circuit during energization, with a resultant fuse blowout. The term "1000 cycles durable" means "passing the 1000 cycle Durability-on-Engine Test" or no material change after the 1000 cycle Durability-on-Engine Test. Also, the term "heating element" appearing in the "Electrode Material" column means that the ion detection electrode 411 and the heating resistor 41 are made of the same material.

TABLE 2

| | Electrode Material | Electrode Coating | Coating Thickness | Results |
|---|---|---|---|---|
| Example 7 | Heating element | Glass | 5 μm | 1000 cycles durable |
| Example 8 | Heating element | Glass | 10 μm | 1000 cycles durable |
| Example 9 | Heating element | Glass | 100 μm | 1000 cycles durable |
| Example 10 | Heating element | Glass | 200 μm | 1000 cycles durable |
| Example 11 | Heating element | Glass | 300 μm | 1000 cycles durable |
| Comparative Example 6 | Heating element | Not coated | 0 | Short after 70 cycles |
| Comparative Example 7 | W | Not coated | 0 | Short after 60 cycles |
| Comparative Example 8 | Ir | Not coated | 0 | Short after 100 cycles |
| Comparative Example 9 | W | Au deposition | 2 μm | Short after 40 cycles |

③ Ion Current Detection Sensitivity Test

Figure 8:
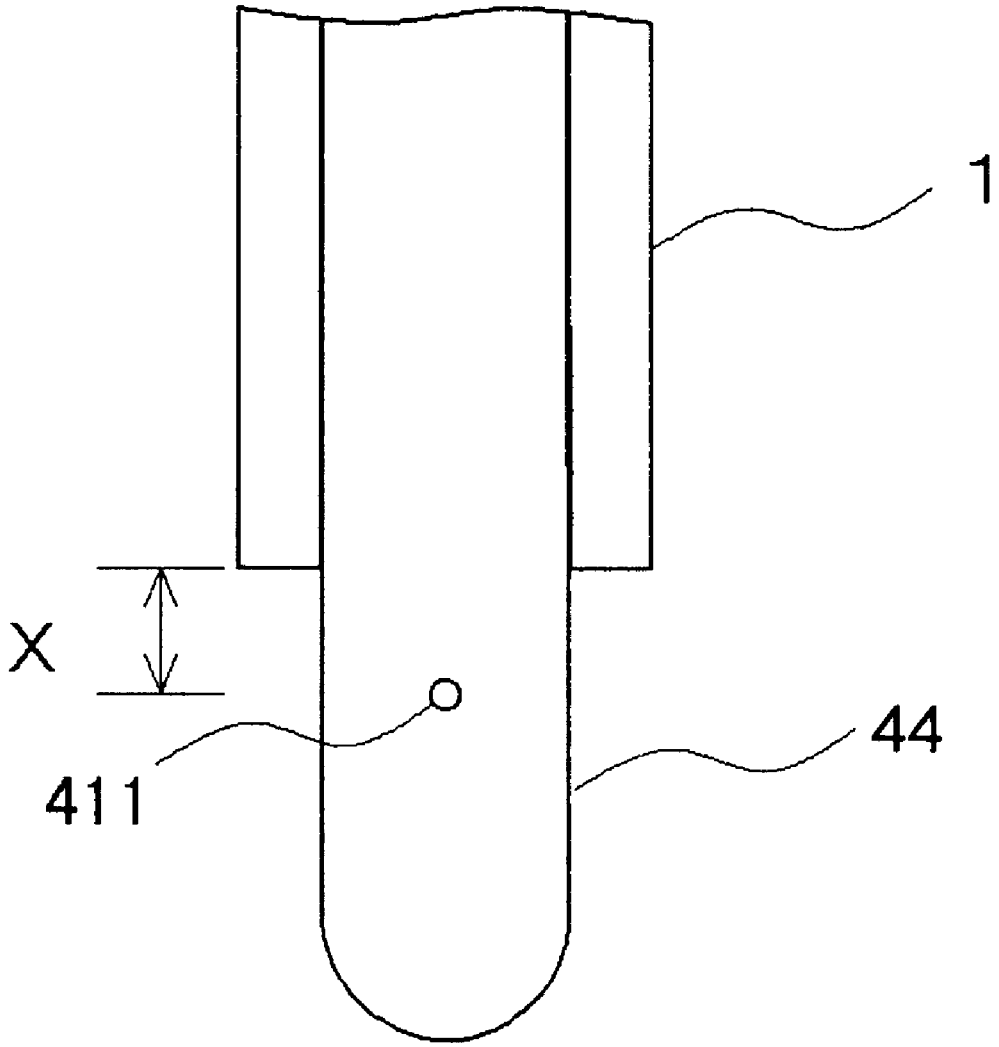
FIG. 8 is a side view showing a main portion of the glow plug according to the embodiment as viewed facing an ion detection electrode.

Glow plugs of Examples 12 and 13 and comparative Example 10 were manufactured according to the above-described method while employing the length of the glass coating region (X) of FIG. 8 as specified in Table 3. Using the glow plugs, voltage was measured which was detected when the ion detection electrode 411 was oriented toward a fuel injection nozzle and when the ion detection electrode 411 was oriented opposite the fuel injection nozzle. Measurement was conducted in the following manner. In the glow plug operation circuit shown in FIG. 7, the direct-current power source 13 supplies a direct-current voltage of 300 V, and the ion current detection resistor 14 assumes a resistance of 10 kΩ. Ion current was detected for 1 minute in the idling state. The average value of detected voltages measured by means of the potentiometer 141 was taken as a measured value.

The test results are shown in Table 3. In FIG. 8, the cross section of the insulator 44 has a diameter of 3.5 mm; the ion detection electrode 411 has a diameter of 0.8 mm; the distance X between the ion detection electrode 411 and the metallic sleeve 1 is 1.5 mm; and the distance between the tip of the insulator 44 and the metallic sleeve 1 is 10 mm.

TABLE 3

| | Glass Coating Region X | Electrode Orientation | Detected Voltage |
|---|---|---|---|
| Example 12 | 2 mm | Toward injection nozzle | 2.0 V |
| | | Opposite injection nozzle | 1.9 V |
| Example 13 | 5 mm | Toward injection nozzle | 2.4 V |
| | | Opposite injection nozzle | 2.3 V |
| Comparative Example 10 | 0 mm | Toward injection nozzle | 0.8 V |
| | | Opposite injection nozzle | 0.3 V |

(3) As shown in Table 1, the glow plugs of comparative Examples 1 to 3, which did not employ the glass coating layer, suffered swelling of the heating element or ion detection electrode with resultant cracking of the insulator after 50–1200 cycles of the durability-to-energization test. The glow plug of comparative Example 4, which employed Au deposition as a coating layer instead of a glass coating layer, suffered cracking of the insulator due to oxidation of W after 250 cycles of the durability-to-energization test. The glow plug of comparative Example 5, which employed an Au—Ni layer applied by baking as a coating layer, suffered separation of the coating layer after 400 cycles of the durability-to-energization test. These test results indicate that the durability to energization of the glow plug is impaired significantly unless the glass coating layer is employed.

By contrast, the glow plugs of Examples 1 to 6, in which the exposed portion of the ion detection electrode was coated with the glass coating layer, endured 2000 cycles or more of the durability-to-energization test, thereby proving to be excellent in durability to energization. Particularly, the glow plugs of Examples 2 to 6, in which the glass coating layer had a thickness of not less than 10 μm, were free of anomaly even after 10,000 cycles of the durability-to-energization test, thereby proving to be particularly excellent in durability to energization.

As shown in Table 2, the glow plugs of comparative Examples 6 to 8, which did not employ the glass coating layer, suffered a short circuit with a resultant fuse blowout due to adhesion of carbon after 60–100 cycles of the durability-on-engine test, which was carried out by use of an actual diesel engine. The glow plug of comparative Example 9, which employed Au deposition as a coating layer, suffered a short circuit with a resultant fuse blowout after 40 test cycles.

By contrast, the glow plugs of Examples 7 to 11, which employed the glass coating layer, did not suffer a short circuit potentially caused by adhesion of carbon even after 1000 test cycles, thereby proving to be favorably usable with an actual diesel engine while being free of anomaly caused by adhesion of carbon.

As shown in Table 3, the glow plug of comparative Example 10, which did not employ the glass coating layer, exhibited a detected voltage of 0.8 V, which is less than half the values exhibited by the glow plugs of Examples 12 and 13. The detected voltage as measured when the electrode is oriented toward the fuel injection nozzle was 0.8 V, whereas the detected voltage as measured when the electrode is oriented opposite the fuel injection nozzle was 0.3 V, which is about 60% less than 0.8 V.

By contrast, the glow plugs of Examples 12 and 13, which employed the glass coating layer, exhibited a detected voltage of about 2.0 V, indicating capability to detect ion current more accurately as compared with comparative Example 10. The difference between the detected voltage as measured when the electrode is oriented toward the fuel injection nozzle and the detected voltage as measured when the electrode is oriented opposite the fuel injection nozzle is within about 10%, indicating that ion current can be detected accurately regardless of electrode orientation. When a glow plug is mounted on an engine by screw engagement, the orientation of the glow plug is unknown. Thus, it is desirable that a glow plug be able to detect ion current accurately regardless of electrode orientation. Therefore, the glow plugs of Examples 12 and 13 are more favorable than the glow plug of comparative Example 10. Furthermore, the glow plug of Example 13, which has a wider glass coating region than that of the glow plug of Example 12, exhibited a detected voltage greater than that exhibited by the glow plug of Example 12, indicating that the wider the glass coating region, the more accurately ion current can be detected.

The present invention is not limited to the above-described embodiments, but may be modified according to purpose and application without departing from the scope of the present invention. For example, the material and diameter of the lead wires 42 and 43 are not particularly limited. The diameter is usually 0.1–1.0 mm, preferably 0.2–0.8 mm. The lead wires 42 and 43 are usually coated with silver. However, the coating material is not particularly limited. Also, the thickness of the coating layer is not particularly limited. In view of cost and a reduction in a reaction layer, the thickness is usually 1–10 μm, preferably 3–8 μm.

The glow plugs embodying the invention employ a glass coating layer which covers an exposed portion of an ion detection electrode, thereby detecting ion current accurately, improving durability, and preventing short circuits potentially caused by adhesion of carbon. The method of manufacturing a glow plug according to the invention can provide a glow plug having the above-mentioned advantages at low cost and in an easy manner.

This application is based on Japanese Patent Application No. Hei. 11-349530 filed Dec. 8, 1999, which is incorporated herein by reference in its entirety.

What is claimed is:

1. A glow plug comprising a ceramic heating member which in turn comprises an insulator, a heating resistor disposed within said insulator, and an ion detection electrode disposed within said insulator, characterized in that a portion of said ion detection electrode is exposed through said insulator and the exposed portion is coated with a glass coating layer.

2. The glow plug as claimed in claim 1, wherein the glass coating layer covers the exposed portion and extends all around a circumference of said insulator.

3. The glow plug as claimed in claim 1, wherein the glass coating layer has a thickness of 10–200 μm.

4. The glow plug as claimed in claim 1, wherein the glass coating layer has a softening point of not lower than 600° C.

5. The glow plug as claimed in claim 1, wherein said ion detection electrode and said heating resistor are made of the same material.

6. The glow plug as claimed in claim 1, wherein a portion of said ion detection electrode is exposed through an opening in said insulator.

* * * * *